US011219323B2

(12) United States Patent
Reynolds et al.

(10) Patent No.: US 11,219,323 B2
(45) Date of Patent: Jan. 11, 2022

(54) EXTENDABLE STRAW AND METHOD OF ASSEMBLY

(71) Applicant: Helen of Troy Limited, St. Michael (BB)

(72) Inventors: Nicholas Reynolds, New York, NY (US); Lance E. Hazelton, Maplewood, NJ (US); Thomas Hanson, New York, NY (US)

(73) Assignee: Helen of Troy Limited, St. Michael (BB)

( * ) Notice: Subject to any disclaimer, the term of this patent is extended or adjusted under 35 U.S.C. 154(b) by 28 days.

(21) Appl. No.: 16/783,287

(22) Filed: Feb. 6, 2020

(65) Prior Publication Data

US 2021/0244217 A1 Aug. 12, 2021

(51) Int. Cl.
*A47G 21/18* (2006.01)

(52) U.S. Cl.
CPC ..... *A47G 21/189* (2013.01); *A47G 21/18* (2013.01)

(58) Field of Classification Search
CPC ..... A47G 21/18; A47G 21/189
USPC ..... 239/33; 285/302
See application file for complete search history.

(56) References Cited

U.S. PATENT DOCUMENTS 4,340,175 A 7/1982 Danek
4,657,182 A 4/1987 Hoshi
4,736,887 A * 4/1988 Inaba ..... A47G 21/189 239/33
4,850,533 A * 7/1989 Hoshi ..... A47G 21/189 239/33
6,585,170 B2 7/2003 Katsukawa
7,997,509 B2 * 8/2011 Karklins ..... B65D 83/0005 239/33
10,123,641 B1 11/2018 Pepper
2002/0166990 A1 11/2002 Yang
2006/0255169 A1 11/2006 Gieson
2012/0160928 A1 * 6/2012 Jo ..... A47G 21/183 239/33
2020/0008599 A1 * 1/2020 Price ..... A47G 21/189
2021/0045558 A1 * 2/2021 Aveles, Jr. ..... A47G 21/189

* cited by examiner

*Primary Examiner* — Steven J Ganey
(74) *Attorney, Agent, or Firm* — Rankin, Hill & Clark LLP

(57) ABSTRACT

An extendable straw includes a relatively smaller diameter tube, a relatively larger diameter tube, and a collar. The smaller diameter tube includes a radially enlarged section adjacent one end. The larger diameter tube receives the smaller diameter tube and is more flexible than the smaller diameter tube. The radially enlarged section contacts and seals against an inner surface of the larger diameter tube. The collar is connected at a non-drinking end of the larger diameter tube, the collar being more rigid than the larger diameter tube and receiving the smaller diameter tube. The smaller diameter tube is movable in an axial direction with respect to both the collar and the larger diameter tube. At least one of the collar and the larger diameter tube cooperates with the radially enlarged section to inhibit further axial movement of the smaller diameter tube with respect to the collar beyond an extended position.

18 Claims, 3 Drawing Sheets

EXTENDABLE STRAW AND METHOD OF ASSEMBLY

BACKGROUND

Conventional telescoping straws typically include at least a first pipe and a second pipe received in the first pipe, where a structure of the first pipe directly engages a structure of the second pipe in a sliding relationship between a slid forward position and a slid back position. It is a current problem in conventional telescoping straws to reliably maintain a functional seal between the first pipe and the second pipe at a sliding point of contact between the first pipe and the second pipe.

Because the first pipe and the second pipe of conventional telescoping straws engage each other directly, the material forming each of the first pipe and the second pipe must be sufficiently rigid so as to maintain a structural integrity of the connection between the first pipe and the second pipe. However, employing such sufficiently rigid materials for the first pipe and the second pipe is not advantageous for maintaining an effective seal at the sliding point of contact between the first pipe and the second pipe. Consequently, conventional telescoping straws lack an adaptive structure between the first pipe and the second pipe that would enable incorporating relatively flexible materials in a telescoping straw design for improving the quality of a seal therebetween.

SUMMARY

In view of the foregoing, an extendable straw includes a relatively smaller diameter tube, a relatively larger diameter tube, and a collar. The relatively smaller diameter tube includes a radially enlarged section adjacent one end. The relatively larger diameter tube receives the relatively smaller diameter tube and is more flexible than the relatively smaller diameter tube. The radially enlarged section of the relatively smaller diameter tube contacts and seals against an inner surface of the relatively larger diameter tube. The collar is connected at a non-drinking end of the relatively larger diameter tube, the collar being more rigid than the relatively larger diameter tube and receiving the relatively smaller diameter tube. The relatively smaller diameter tube is movable in an axial direction with respect to both the collar and the relatively larger diameter tube. At least one of the collar and the relatively larger diameter tube cooperates with the radially enlarged section of the relatively smaller diameter tube to inhibit further axial movement of the relatively smaller diameter tube with respect to the collar beyond an extended position.

In addition, a method of assembling the extendable straw includes connecting the collar to the non-drinking end of the relatively larger diameter tube. The method further includes inserting the relatively smaller diameter tube through the relatively larger diameter tube and the collar such that the proximal end of the relatively smaller diameter tube is disposed extending axially from the first end of the collar, and the distal end of the relatively smaller diameter tube is disposed extending axially from the second end of the collar. The radially enlarged section is disposed within the relatively larger diameter tube between the collar and the drinking end of the relatively larger diameter tube. The relatively larger diameter tube has the narrowed portion extending from the inner surface adjacent the drinking end of the relatively larger diameter tube through which the radially enlarged section of the relatively smaller diameter tube cannot pass.

DETAILED DESCRIPTION

Figure 1:
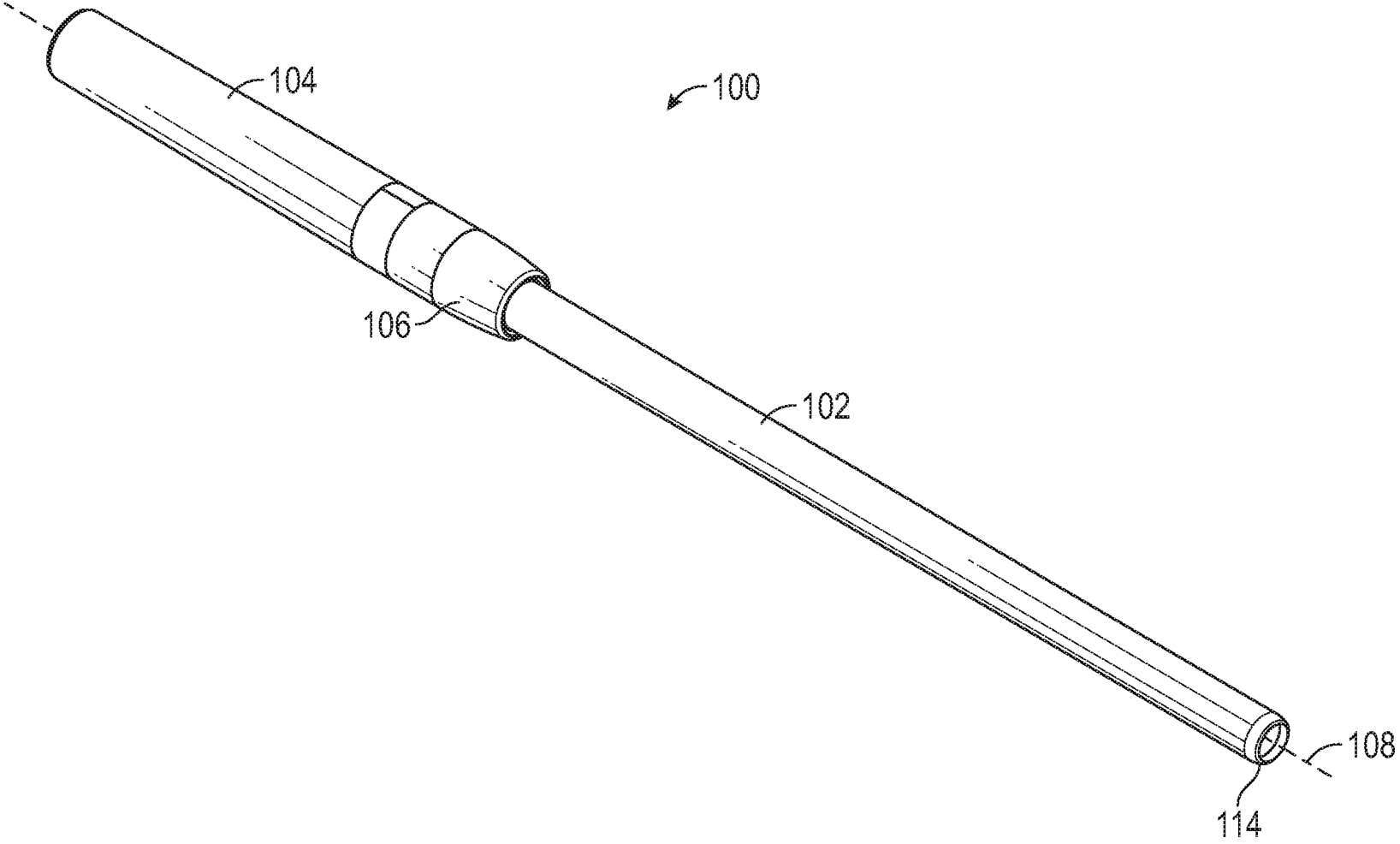
FIG. 1 is a perspective view of an extendable straw.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 is a perspective view of an extendable straw 100 including a relatively smaller diameter tube 102, a relatively larger diameter tube 104, and a collar 106. The relatively smaller diameter tube 102, the relatively larger diameter tube 104, and the collar 106 are shown as circular when viewed normal to a longitudinal axis 108 of the extendable straw 100; however, each could take another shape such as elliptical or polygonal, for example.

Figure 2:
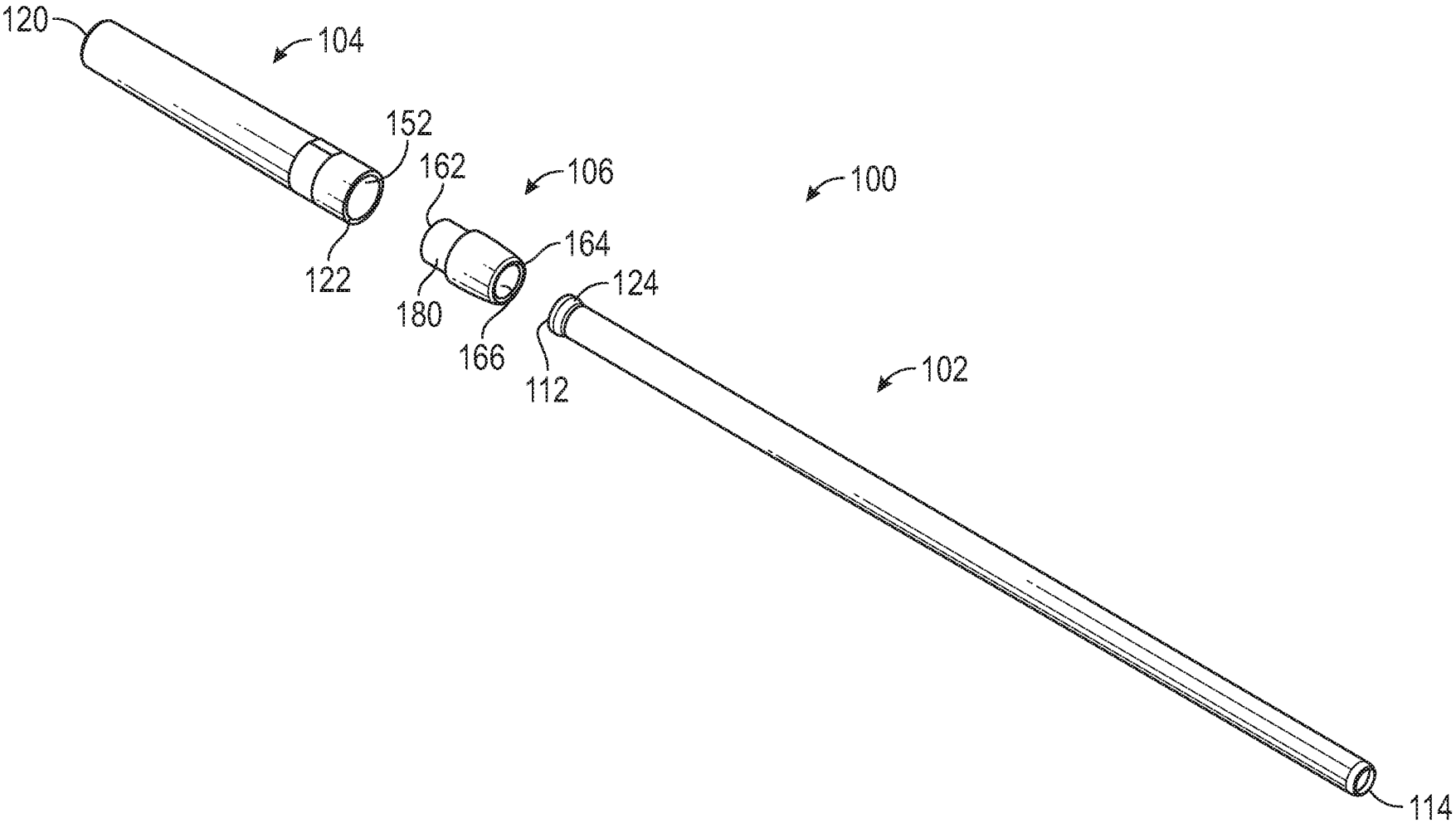
FIG. 2 is an exploded view of the extendable straw of FIG. 1.

The relatively smaller diameter tube 102 includes a proximal end 112 (see FIG. 2) and a distal end 114. The relatively larger diameter tube 104 includes what will be referred to as a drinking end 120 that will typically end up in a user's mouth when in use and a non-drinking end 122 that is opposite the drinking end 120. In alternative orientation, the distal end 114 of the relatively smaller diameter tube 102 can operate as a drinking end while the drinking end 120 of the relatively larger diameter tube 104 operates as a non-drinking end without departing from the present disclosure. The relatively larger diameter tube 104 receives the relatively smaller diameter tube 102, and is more flexible than the relatively smaller diameter tube 102. The collar 106 is connected at the non-drinking end 122 of the relatively larger diameter tube 104, receives the relatively smaller diameter tube 102, and is more rigid than the relatively larger diameter tube 104.

In the illustrated embodiment, the relatively smaller diameter tube 102 is made from a material that is more rigid than the material from which the relatively larger diameter tube 104 is made. In the illustrated embodiment, the relatively smaller diameter tube 102 is made from metal and the relatively larger diameter tube 104 is made from food grade silicone. Alternatively, the relatively smaller diameter tube 102 can be made from a rigid plastic or another material that is more rigid than the material from which the relatively larger diameter tube 104 is made. If desired, the relatively smaller diameter tube 102 and the relatively larger diameter tube 104 can be made from the same material rigid so long as the material is rigid enough so as not to collapse when retracting the relatively smaller diameter tube 102 into the larger diameter tube 104.

Figure 3:
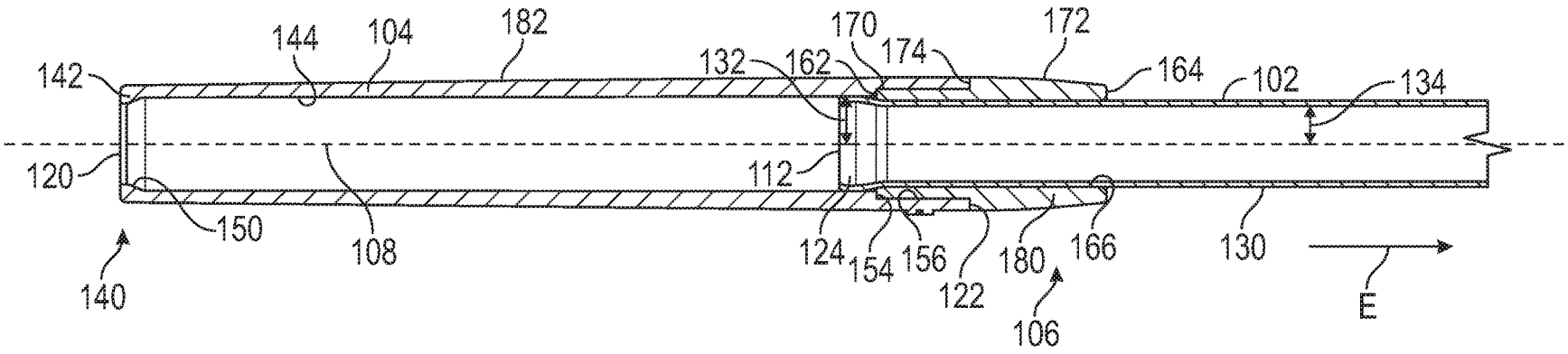
FIG. 3 is a partial cross-sectional side view of the straw in an extended position.

With reference to FIG. 3, the relatively smaller diameter tube 102 includes a radially enlarged section 124 adjacent the proximal end 112. The radially enlarged section 124 can be formed by deforming the relatively smaller diameter tube 102 so as to extend an outer surface 130 of the relatively smaller diameter tube 102 radially outward with respect to the longitudinal axis 108 of the extendable straw 100. As such, the outer surface 130 along the radially enlarged section 124 is offset a greater distance 132 from the longitudinal axis 108 along the radially enlarged section 124 as compared to a distance 134 that the outer surface 130 is offset from the longitudinal axis 108 along locations not along the radially enlarged section 124. In lieu of deforming the relatively smaller diameter tube 102, the radially enlarged section 124 could be formed by providing an extension, e.g., a ring-shaped flange, around the outside of the relatively smaller diameter tube 102 so as to extend the outer surface 130 of the relatively smaller diameter tube 102 radially outward with respect to the longitudinal axis 108.

The relatively larger diameter tube 104 includes a narrowed portion 140, which is formed by at least one protrusion 142 provided near the drinking end 120 in the illustrated embodiment. As shown, the at least one protrusion 142 extends radially inwardly from a main inner surface 144 of the relatively larger diameter tube 104 adjacent the drinking end 120 of the relatively larger diameter tube 104. The at least one protrusion 142 could be provided elsewhere, e.g., offset from the drinking end 120 towards the non-drinking end 122. The at least one protrusion 142 can be a ridge disposed circumferentially and extending radially inwardly from the main inner surface 144 of the relatively larger diameter tube 104. In this manner, the narrowed portion 140 narrows a diameter and a lateral cross section (taken normal to the longitudinal axis 108) of the relatively larger diameter tube 104. The narrowed portion 140 defines a narrowed portion inclined face 150 directed radially inward with respect to a longitudinal axis 108 in a direction going from the non-drinking end 122 toward the drinking end 120.

Extending from the non-drinking end 122 toward the drinking end 120, the relatively larger diameter tube 104 includes a counterbore 152 (FIG. 2) having a larger diameter than the section of the relatively larger diameter tube 104 along the main inner surface 144. An inner surface step 154 is provided normal to the longitudinal axis 108 connecting the main inner surface 144 with a counterbore inner surface 156, which is offset a greater radius 158 from the longitudinal axis 108 as compared to a radius 160 that the main inner surface 144 is offset from the longitudinal axis 108.

The collar 106 has a first end 162 and a second end 164 located opposite the first end 162. The collar 106 includes an internal surface 166 and an outer surface made up of a proximal outer surface section 170, a distal outer surface section 172, and a shoulder 174 that is normal to the longitudinal axis 108 and connects the proximal outer surface section 170 and the distal outer surface section 172. As shown, the shoulder 174 radially extends from the proximal outer surface section 170 of the collar 106 with respect to a radial direction of the collar 106. In this manner, the shoulder 174 forms and end of a necked down portion 180 of the collar 106 extending from the first end 162 of the collar 106 to the shoulder 174. When assembled, the necked down portion 180 of the collar 106 is received in the counterbore 152 and is retained in the counterbore 152 via a friction fit, weld or adhesive between the counterbore inner surface 156 and the proximal outer surface section 170. Alternatively, the collar 106 can connect to the non-drinking end 122 of the relatively larger tube 104 by overmolding the relatively larger tube 104 onto the collar 106.

The relatively smaller diameter tube 102, the relatively larger diameter tube 104, and the collar 106 are assembled to form the extendable straw 100. When assembled, an outer surface 182 of the relatively larger diameter tube 104 is flush with the distal outer surface section 172 of the collar 106 to provide a smooth and ergonomic hand feeling to a user employing the extendable straw 100. The relatively larger diameter tube 104 receives the relatively smaller diameter tube 102 such that the proximal end 112 of the relatively smaller diameter tube 102 is disposed within the relatively larger diameter tube 104 between the drinking end 120 and the non-drinking end 122 of the relatively larger diameter tube 104, and more particularly between narrowed portion inclined face 150 and the first end 162 of the collar 106. In this manner, the relatively smaller diameter tube 102 is movable between a retracted position (FIG. 4) and an extended position (FIG. 3) relative to the relatively larger diameter tube 104 and the collar 106. Movement from the retracted position to the extended position is in the direction of arrow E in FIG. 3. Movement from the extended position to the retracted position is in the direction of arrow R in FIG. 4.

An apex 184 (e.g., a location offset farthest from the longitudinal axis 108) of the outer surface 130 in the radially enlarged section 124 of the relatively smaller diameter tube 102 contacts and seals against the main inner surface 144 of the relatively larger diameter tube 104. The seal created between the radially enlarged section 124 and the relatively larger diameter tube 104 can be watertight and so as to enable use of the relatively smaller diameter tube 102 and the relatively larger diameter tube 104 together as a drinking straw. Because the main inner surface 144 of the relatively larger diameter tube 104 has a constant diameter between the narrowed portion 140 and the inner surface step 154, the seal is functional for a drinking straw when the relatively smaller diameter tube 102 is positioned at any location along the relatively larger diameter tube 104 between the extended position and the retracted position.

The sealing force causing the seal between the relatively smaller diameter tube 102 and the relatively larger diameter tube 104, and coefficient of friction between the radially enlarged section 124 and the main inner surface 144 of the relatively larger diameter tube 104 provide a static friction force. The static friction force is small enough for a user to comfortably adjust a position of the relatively smaller diameter tube 102 with respect to the relatively larger diameter tube 104 between the extended position and the retracted position. Also, the static friction force is large enough to reliably hold the relatively smaller diameter tube 102 in a position with respect to the relatively larger diameter tube 104 between the extended position and the retracted position.

The collar 106 is received in the counterbore 152 of the relatively larger diameter tube 104 and extends from the non-drinking end 122. The collar 106 also receives the relatively smaller diameter tube 102. With this construction, the relatively smaller diameter tube 102 is movable in an axial direction between the extended position and the retracted position with respect to both the collar 106 and the relatively larger diameter tube 104. The collar 106 cooperates with the radially enlarged section 124 of the relatively smaller diameter tube 102 to inhibit further axial movement of the relatively smaller diameter tube 102 with respect to the collar 106 beyond the extended position.

Notably, the internal surface 166 of the collar 106 has a longitudinal length and radial proximity to the outer surface 130 of the relatively smaller diameter tube 102 sufficient to maintain axial alignment between the collar 106 and the relatively smaller diameter tube 102. As a result, when the relatively smaller diameter tube 102 is inserted in the collar 106, the proximal end 112 of the relatively smaller diameter tube 102 is disposed extending axially from the first end 162 of the collar 106, and the distal end 114 of the relatively smaller diameter tube 102 is disposed extending axially from the second end 164 of the collar 106. Because the collar 106 is more rigid than the relatively larger diameter tube 104, the collar 106 can be better adapted for maintaining axial alignment between the relatively smaller diameter tube 102 and the relatively larger diameter tube 104, and can also be better adapted for maintaining a structural integrity of the extendable straw 100 regarding connecting the relatively smaller diameter tube 102 and the relatively larger diameter tube 104.

As shown, the relatively larger diameter tube 104 receives the necked down portion 180 of the collar 106 and the shoulder 174 abuts the non-drinking end 122 of the relatively larger diameter tube 104. A longitudinal distance between the non-drinking end 122 and the inner surface step 154 coincides with a longitudinal length of the necked down portion 180 such that the relatively larger diameter tube 104 also receives the necked down portion 180 of the collar 106 with the inner surface step 154 of the relatively larger diameter tube 104 abutting the first end 162 of the collar 106.

The collar 106 and the relatively larger diameter tube 104 may be reconfigured such that the collar 106 receives the relatively larger diameter tube 104 therein, without departing from the scope of the present disclosure. Also, either or both the inner surface step 154 and the shoulder 174 may be reconfigured to obstruct relative axial movement between the relatively larger diameter tube 104 and the collar 106 beyond an assembled position of the relatively larger diameter tube 104 and the collar 106.

A portion of the first end 162 of the collar 106 extends radially inward beyond the main inner surface 144 of the relatively larger diameter tube 104 at the inner surface step 154. The relatively larger diameter tube 104 engages the collar 106 such that the main inner surface 144 of the relatively larger diameter tube 104, the first end 162 of the collar 106, and the internal surface 166 of the collar 106 together form a narrowed section, which is opposite to the narrowed portion 140, that is configured to inhibit further axial movement in the direction of arrow E of the relatively smaller diameter tube 102 with respect to the relatively larger diameter tube 104 and the collar 106 beyond the extended position.

Figure 4:
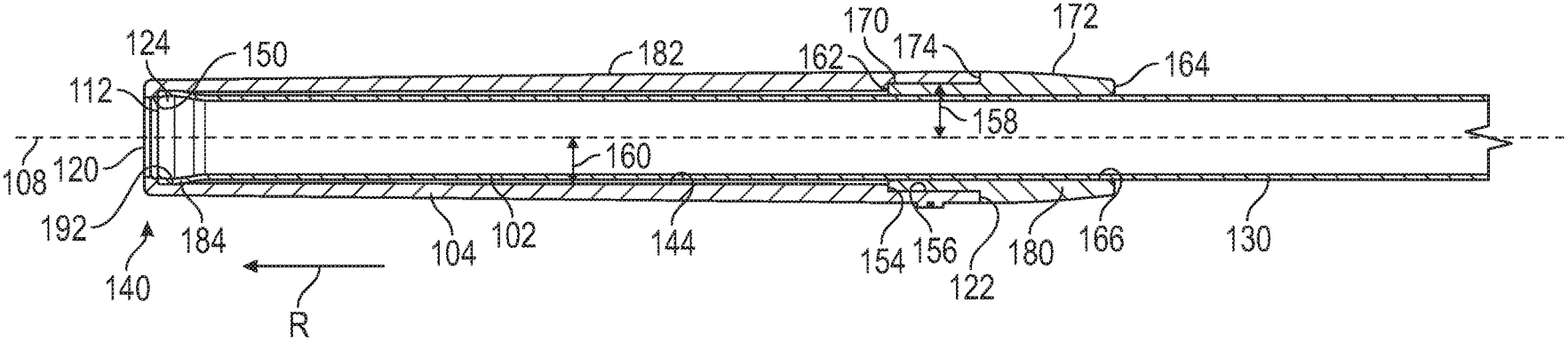
FIG. 4 is a partial cross-sectional side view of the straw in a retracted position.

With reference to FIG. 4, the narrowed portion 140 of the relatively larger diameter tube 104 cooperates with the radially enlarged section 124 of the relatively smaller diameter tube 102 to inhibit further axial movement in the direction of arrow R of the relatively smaller diameter tube 102 with respect to the relatively larger diameter tube 104 beyond a retracted position. As shown in FIG. 4, the narrowed portion inclined face 150 contacts the radially enlarged section 124 when the relatively smaller diameter tube 102 is in the retracted position. Notably, the narrowed portion inclined face 150 and a proximal surface 192 of the radially enlarged section 124 being complementary with each other when the relatively smaller diameter tube 102 is in the retracted position increases a surface area of contact between the relatively smaller diameter tube 102 and the relatively larger diameter tube 104, and in this manner improves the seal between the relatively smaller diameter tube 102 and the relatively larger diameter tube 104 when the relatively smaller diameter tube 102 is in the retracted position.

The radially enlarged section 124 is configured to form an interference fit with the main inner surface 144 of the relatively larger diameter tube 104. Because the relatively larger diameter tube 104 is also more flexible than the relatively smaller diameter tube 102, the radially enlarged section 124 deforms the main inner surface 144 of the relatively larger diameter tube 104 where the radially enlarged section 124 contacts the relatively larger diameter tube 104, improving the seal between the relatively smaller diameter tube 102 and the relatively larger diameter tube 104.

A method of assembling the extendable straw 100 will be described next. The order of steps can differ from the order that each step is described below. The method includes connecting the collar 106 to the non-drinking end 122 of the relatively larger diameter tube 104. The method further includes inserting the relatively smaller diameter tube 102 through the relatively larger diameter tube 104 and the collar 106 such that the proximal end 112 of the relatively smaller diameter tube 102 is disposed extending axially from the first end 162 of the collar 106, and the distal end 114 of the relatively smaller diameter tube 102 is disposed extending axially from the second end 164 of the collar 106. The radially enlarged section 124 is disposed within the relatively larger diameter tube 104 between the collar 106 and the drinking end 120 of the relatively larger diameter tube 104. As mentioned above, the relatively larger diameter tube 104 has the narrowed portion 140 extending from the main inner surface 144 adjacent the drinking end 120 of the relatively larger diameter tube 104 through which the radially enlarged section 124 of the relatively smaller diameter tube 102 cannot pass.

The collar 106 can be permanently affixed, e.g., glued to the relatively larger diameter tube 104. Connecting the collar 106 to the non-drinking end 122 of the relatively larger diameter tube 104 can include inserting the necked down portion 180 of the collar 106 into the relatively larger diameter tube 104 until the first end 162 of the collar 106 abuts the inner surface step 154 of the relatively larger diameter tube 104, or the non-drinking end 122 of the relatively larger diameter tube 104 abuts the shoulder 174 of the collar 106. Connecting the collar 106 to the non-drinking end 122 of the relatively larger diameter tube 104 could also be accomplished by overmolding the relatively larger tube 104 onto the collar 106.

It will be appreciated that variations of the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An extendable straw comprising:

a relatively smaller diameter tube including a radially enlarged section adjacent one end;

a relatively larger diameter tube that receives the relatively smaller diameter tube, the relatively larger diameter tube being more flexible than the relatively smaller diameter tube and the radially enlarged section of the relatively smaller diameter tube contacts and seals against an inner surface of the relatively larger diameter tube; and a collar connected at a non-drinking end of the relatively larger diameter tube, the collar being more rigid than the relatively larger diameter tube and receiving the relatively smaller diameter tube, wherein the relatively smaller diameter tube is movable in an axial direction with respect to both the collar and the relatively larger diameter tube and at least one of the collar and the relatively larger diameter tube cooperates with the radially enlarged section of the relatively smaller diameter tube to inhibit further axial movement of the relatively smaller diameter tube with respect to the collar beyond an extended position.

2. The extendable straw of claim 1, wherein an outer surface of the relatively larger diameter tube is flush with an outer surface section of the collar when the relatively larger diameter tube is assembled with the collar.

3. The extendable straw of claim 1, wherein the collar includes a necked down portion and the relatively larger diameter tube receives the necked down portion of the collar.

4. The extendable straw of claim 3, wherein the collar includes a shoulder provided on an outer surface of the collar, wherein the relatively larger diameter tube receives the necked down portion of the collar with the shoulder abutting the non-drinking end of the relatively larger diameter tube.

5. The extendable straw of claim 3, wherein the relatively larger diameter tube includes an inner surface step, and the relatively larger diameter tube receives the necked down portion of the collar with the inner surface step abutting a first end of the collar.

6. The extendable straw of claim 5, wherein a portion of the first end of the collar received in the relatively larger diameter tube extends radially inward beyond a main inner surface of the relatively larger diameter tube at the inner surface step.

7. The extendable straw of claim 6, wherein the portion of the end of the collar received in the relatively larger diameter tube extending radially inward beyond the main inner surface of the relatively larger diameter tube is configured to inhibit further axial movement of the relatively smaller diameter tube with respect to the collar beyond the extended position.

8. The extendable straw of claim 1, wherein a main inner surface of the relatively larger diameter tube located between the collar and a drinking end of the relatively larger diameter tube has a relatively larger diameter than an internal surface of the collar.

9. The extendable straw of claim 1, wherein the relatively larger diameter tube includes a narrowed portion extending radially inwardly from a main inner surface of the relatively larger diameter tube adjacent a drinking end, the narrowed portion cooperates with the radially enlarged section of the relatively smaller diameter tube to inhibit further axial movement of the relatively smaller diameter tube with respect to the larger diameter tube beyond a retracted position.

10. The extendable straw of claim 9, wherein the narrowed portion includes a narrowed portion inclined face, and the a proximal surface defined by the radially enlarged section having a shape that complements the narrowed portion inclined face when the relatively smaller diameter tube is disposed in the retracted position.

11. The extendable straw of claim 1, wherein radially enlarged section deforms the inner surface.

12. A method of assembling an extendable straw, the method comprising:

connecting a collar to a non-drinking end of a relatively larger diameter tube; and inserting a relatively smaller diameter tube through the relatively larger diameter tube and the collar such that a proximal end of the relatively smaller diameter tube is disposed extending axially from a first end of the collar, and a distal end of the relatively smaller diameter tube is disposed extending axially from a second end of the collar opposite the first end of the collar, the relatively smaller diameter tube including a radially enlarged section adjacent to the proximal end that cannot pass through the collar, and the radially enlarged section being disposed within the relatively larger diameter tube between the collar and a drinking end of the relatively larger diameter tube, the relatively larger diameter tube having a narrowed portion extending from an inner surface adjacent the drinking end of the relatively larger diameter tube through which the radially enlarged section of the relatively smaller diameter tube cannot pass, wherein connecting the collar to the non-drinking end of the relatively larger tube includes;

inserting a necked down portion of the collar into the relatively larger diameter tube until the first end of the collar abuts an inner surface step of the relatively larger diameter tube, or the second end of the end relatively larger diameter tube abuts a shoulder provided on an outer surface of the collar, or overmolding the relatively larger tube onto the collar.

13. The method of assembling the extendable straw according to claim 12, wherein the relatively larger diameter tube is more flexible than the relatively smaller diameter tube and the radially enlarged section of the relatively smaller diameter tube contacts and seals against the inner surface of the relatively larger diameter tube.

14. An extendable straw comprising:

a relatively smaller diameter tube including a radially enlarged section adjacent one end;

a relatively larger diameter tube that receives the relatively smaller diameter tube, the relatively larger diameter tube being more flexible than the relatively smaller diameter tube and the radially enlarged section of the relatively smaller diameter tube contacts and seals against an inner surface of the relatively larger diameter tube; and a collar connected at a non-drinking end of the relatively larger diameter tube, the collar receiving the relatively smaller diameter tube, wherein the relatively smaller diameter tube is movable in an axial direction with respect to both the collar and the relatively larger diameter tube and at least one of the collar and the relatively larger diameter tube cooperates with the radially enlarged section of the relatively smaller diameter tube to inhibit further axial movement of the relatively smaller diameter tube with respect to the collar beyond an extended position, wherein the collar includes a necked down portion and the relatively larger diameter tube receives the necked down portion of the collar.

15. The extendable straw of claim 14, wherein the collar includes a shoulder provided on an outer surface of the collar, wherein the relatively larger diameter tube receives the necked down portion of the collar with the shoulder abutting the non-drinking end of the relatively larger diameter tube.

16. The extendable straw of claim 14, wherein the relatively larger diameter tube includes an inner surface step, and the relatively larger diameter tube receives the necked down portion of the collar with the inner surface step abutting a first end of the collar.

17. The extendable straw of claim 14, wherein a portion of the first end of the collar received in the relatively larger diameter tube extends radially inward beyond a main inner surface of the relatively larger diameter tube at the inner surface step.

18. The extendable straw of claim 17, wherein the portion of the end of the collar received in the relatively larger diameter tube extending radially inward beyond the main inner surface of the relatively larger diameter tube is configured to inhibit further axial movement of the relatively smaller diameter tube with respect to the collar beyond the extended position.

* * * * *